US012460854B2

(12) United States Patent
Mitchell

(10) Patent No.: US 12,460,854 B2
(45) Date of Patent: Nov. 4, 2025

(54) SWEEP ASSEMBLY FOR A REFRIGERATOR ICEMAKER

(71) Applicant: Haier US Appliance Solutions, Inc., Wilmington, DE (US)

(72) Inventor: Alan Joseph Mitchell, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 161 days.

(21) Appl. No.: 18/474,788

(22) Filed: Sep. 26, 2023

(65) Prior Publication Data

US 2025/0102214 A1 Mar. 27, 2025

(51) Int. Cl.
*F25C 5/04* (2006.01)
*F25C 1/10* (2006.01)
*F25C 5/06* (2006.01)

(52) U.S. Cl.
CPC ..... *F25C 5/043* (2013.01); *F25C 1/10* (2013.01); *F25C 5/06* (2013.01); *F25C 2305/0221* (2021.08); *F25C 2400/10* (2013.01)

(58) Field of Classification Search
CPC .... F25C 5/043; F25C 1/10; F25C 5/06; F25C 2305/0221; F25C 5/04; F25C 1/243
See application file for complete search history.

(56) References Cited

U.S. PATENT DOCUMENTS 2,717,500 A 9/1955 Ploeger
2,808,707 A 10/1957 Chace
2,957,604 A * 10/1960 Goldman ..... F25C 5/20 221/277
3,060,700 A * 10/1962 Patsy ..... F25C 1/04 62/353
3,163,018 A 12/1964 Shaw
3,182,464 A 5/1965 Archer
4,669,271 A 6/1987 Noel
4,791,411 A 12/1988 Staar
7,810,891 B2 10/2010 Lee et al.
9,234,689 B2 1/2016 Son et al.
9,696,079 B2 7/2017 Boarman et al.
(Continued)

FOREIGN PATENT DOCUMENTS

CN 201450894 U 5/2010
CN 205619681 U 10/2016
(Continued)

*Primary Examiner* — David J Teitelbaum
(74) *Attorney, Agent, or Firm* — Dority & Manning, P.A.

(57) ABSTRACT

An ice making assembly includes a resilient mold defining a mold cavity for forming one or more ice cubes, a mold frame being rotatable between a first position and a second position, a lifter mechanism positioned adjacent to the resilient mold and rotatable with the mold frame between the first position and the second position, the lifter mechanism configured to deform the resilient mold as the mold frame rotates between the first position and the second position, and a sweep assembly to facilitate extraction of the one or more ice cubes from the resilient mold. The sweep assembly includes a sweep blade slidably mounted to the mold frame over the resilient mold and being movable between a first position and a second position and a mechanical stop that moves the sweep blade toward the second position as the lifter mechanism moves toward the second position.

20 Claims, 6 Drawing Sheets

(56) References Cited

U.S. PATENT DOCUMENTS

| | | | | |
|---|---|---|---|---|
| 10,443,915 | B2 | 10/2019 | Little et al. | |
| 10,788,252 | B2 | 9/2020 | Mitchell et al. | |
| 11,175,084 | B2 | 11/2021 | Mitchell | |
| 11,306,966 | B2 | 4/2022 | Schroeder et al. | |
| 11,353,253 | B2 | 6/2022 | Kim et al. | |
| 11,486,623 | B2 | 11/2022 | Mitchell | |
| 11,519,775 | B2 | 12/2022 | Vijayan et al. | |
| 11,543,167 | B2 | 1/2023 | Mitchell | |
| 2003/0131541 | A1 | 7/2003 | Lee et al. | |
| 2006/0086134 | A1* | 4/2006 | Voglewede | F25C 5/06 62/353 |
| 2009/0255292 | A1 | 10/2009 | Benz | |
| 2010/0218542 | A1 | 9/2010 | McCollough et al. | |
| 2013/0014535 | A1 | 1/2013 | Son et al. | |
| 2013/0081412 | A1 | 4/2013 | Son et al. | |
| 2013/0327074 | A1 | 12/2013 | Lee et al. | |
| 2014/0165598 | A1 | 6/2014 | Boarman et al. | |
| 2014/0165621 | A1 | 6/2014 | Boarman et al. | |
| 2014/0182325 | A1 | 7/2014 | Lee et al. | |
| 2014/0320040 | A1 | 10/2014 | Katu et al. | |
| 2018/0259245 | A1 | 9/2018 | Gunawardana et al. | |
| 2019/0293335 | A1 | 9/2019 | Bertolini et al. | |
| 2019/0353421 | A1 | 11/2019 | Junge et al. | |
| 2020/0158403 | A1 | 5/2020 | Hong et al. | |
| 2020/0158413 | A1 | 5/2020 | Kim et al. | |
| 2020/0208904 | A1 | 7/2020 | Choy et al. | |
| 2021/0041154 | A1* | 2/2021 | Mitchell | F25C 5/06 |
| 2021/0055043 | A1 | 2/2021 | Wantland | |
| 2021/0088270 | A1 | 3/2021 | Allgeier | |
| 2021/0164725 | A1 | 6/2021 | Kumar | |
| 2022/0067642 | A1 | 3/2022 | Barton | |
| 2022/0252337 | A1 | 8/2022 | Ryu | |

FOREIGN PATENT DOCUMENTS

| | | | |
|---|---|---|---|
| CN | 113237284 | A | 8/2021 |
| CN | 214491084 | U | 10/2021 |
| ES | 26884 | U | 6/1951 |
| JP | S63155978 | U | 10/1988 |
| JP | 01123969 | A | 5/1989 |
| JP | H0689970 | B | 11/1994 |
| JP | 2017215067 | A | 12/2017 |
| KR | 20140127590 | A | 11/2014 |

* cited by examiner

SWEEP ASSEMBLY FOR A REFRIGERATOR ICEMAKER

FIELD OF THE INVENTION

The present subject matter relates generally to refrigerator appliances, and more particularly to ice making assemblies for refrigerator appliances.

BACKGROUND OF THE INVENTION

Refrigerator appliances generally include a cabinet that defines one or more chilled chambers for receipt of food articles for storage. Typically, one or more doors are rotatably hinged to the cabinet to permit selective access to food items stored in the chilled chamber. Further, refrigerator appliances commonly include ice making assemblies mounted within an icebox on one of the doors or in a freezer compartment. The ice is stored in a storage bin and is accessible from within the freezer chamber or may be discharged through a dispenser recess defined on a front of the refrigerator door.

Craft ice has recently become a popular feature in household refrigerators. Craft ice can be any shape but is typically much larger than typical crescent cubes. For example, a craft icemaker may work by filling a rubber mold with water and allowing it to freeze. The mold assembly may contain ejectors that push the ice cubes out of the mold as it is rotated by a DC motor. However, after many harvests the ice can stick to the rubber mold, such that the cubes are pulled back into the mold when the mold assembly rotates back to the home position. The icemaker then overfills on the next cycle causing the ice bucket to freeze into a large clump, which is not usable by a consumer.

Accordingly, a refrigerator appliance with features for improved ice dispensing would be desirable. More particularly, an ice making assembly for a refrigerator appliance that efficiently and reliably discharges ice would be particularly beneficial.

BRIEF DESCRIPTION OF THE INVENTION

Aspects and advantages of the invention will be set forth in part in the following description, or may be apparent from the description, or may be learned through practice of the invention.

In one exemplary embodiment, an ice making assembly for a refrigerator appliance is provided, including a resilient mold defining a mold cavity for receiving water, a mold frame for supporting the resilient mold, the mold frame being rotatable between a first position and a second position, a heat exchanger in thermal communication with the resilient mold to freeze the water and form one or more ice cubes, a lifter mechanism positioned adjacent to the resilient mold and rotatable with the mold frame between the first position and the second position, the lifter mechanism configured to deform the resilient mold as the mold frame rotates between the first position and the second position, and a sweep assembly to facilitate extraction of the one or more ice cubes from the resilient mold. The sweep assembly includes a sweep blade slidably mounted to the mold frame over the resilient mold and being movable between a first position and a second position and a mechanical stop that moves the sweep blade toward the second position as the lifter mechanism moves toward the second position.

In another exemplary embodiment, a refrigerator appliance defining a vertical direction, a lateral direction, and a transverse direction is provided. The refrigerator appliance includes a cabinet defining a chilled chamber, a door being rotatably mounted to the cabinet to provide selective access to the chilled chamber, an icebox mounted to the door and defining an ice making chamber, and an ice making assembly positioned within the ice making chamber. The ice making assembly includes a resilient mold defining a mold cavity for receiving water, a mold frame for supporting the resilient mold, the mold frame being rotatable between a first position and a second position, a heat exchanger in thermal communication with the resilient mold to freeze the water and form one or more ice cubes, a lifter mechanism positioned adjacent to the resilient mold and rotatable with the mold frame between the first position and the second position, the lifter mechanism configured to deform the resilient mold as the mold frame rotates between the first position and the second position, and a sweep assembly to facilitate extraction of the one or more ice cubes from the resilient mold, the sweep assembly comprising: a sweep blade slidably mounted to the mold frame over the resilient mold and being movable between a first position and a second position; and a mechanical stop that moves the sweep blade toward the second position as the lifter mechanism moves toward the second position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
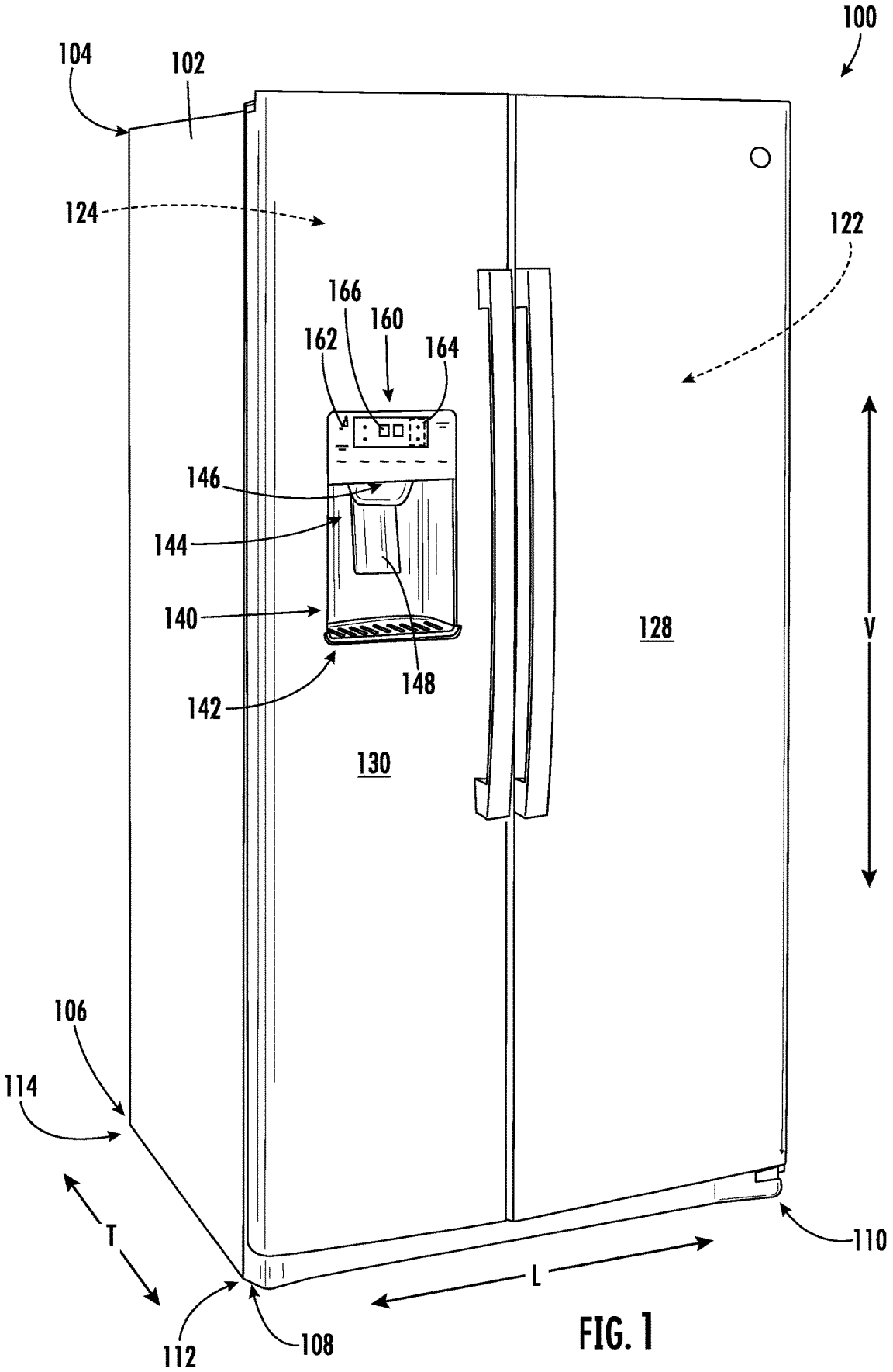
FIG. 1 provides a perspective view of a refrigerator appliance according to an exemplary embodiment of the present subject matter.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). The term "at least one of" in the context of, e.g., "at least one of A, B, and C" refers to only A, only B, only C, or any combination of A, B, and C. In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a refrigerator appliance 100 according to an exemplary embodiment of the present subject matter. Refrigerator appliance 100 includes a cabinet or housing 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another.

Housing 102 defines chilled chambers for receipt of food items for storage. In particular, housing 102 defines fresh food chamber 122 positioned at or adjacent second side 110 of housing 102 and a freezer chamber 124 arranged at or adjacent first side 108 of housing 102. As such, refrigerator appliance 100 is generally referred to as a side-by-side refrigerator. It is recognized, however, that the benefits of the present disclosure apply to other types and styles of refrigerator appliances such as, e.g., a top mount refrigerator appliance, a bottom mount refrigerator appliance, or a single door refrigerator appliance. Consequently, the description set forth herein is for illustrative purposes only and is not intended to be limiting in any aspect to any particular refrigerator chamber configuration.

A refrigerator door 128 is rotatably hinged to an edge of housing 102 for selectively accessing fresh food chamber 122. In addition, a freezer door 130 is rotatably hinged to an edge of housing 102 for selectively accessing freezer chamber 124. Refrigerator door 128 and freezer door 130 are shown in the closed configuration in FIG. 1. One skilled in the art will appreciate that other chamber and door configurations are possible and within the scope of the present invention.

Figure 2:
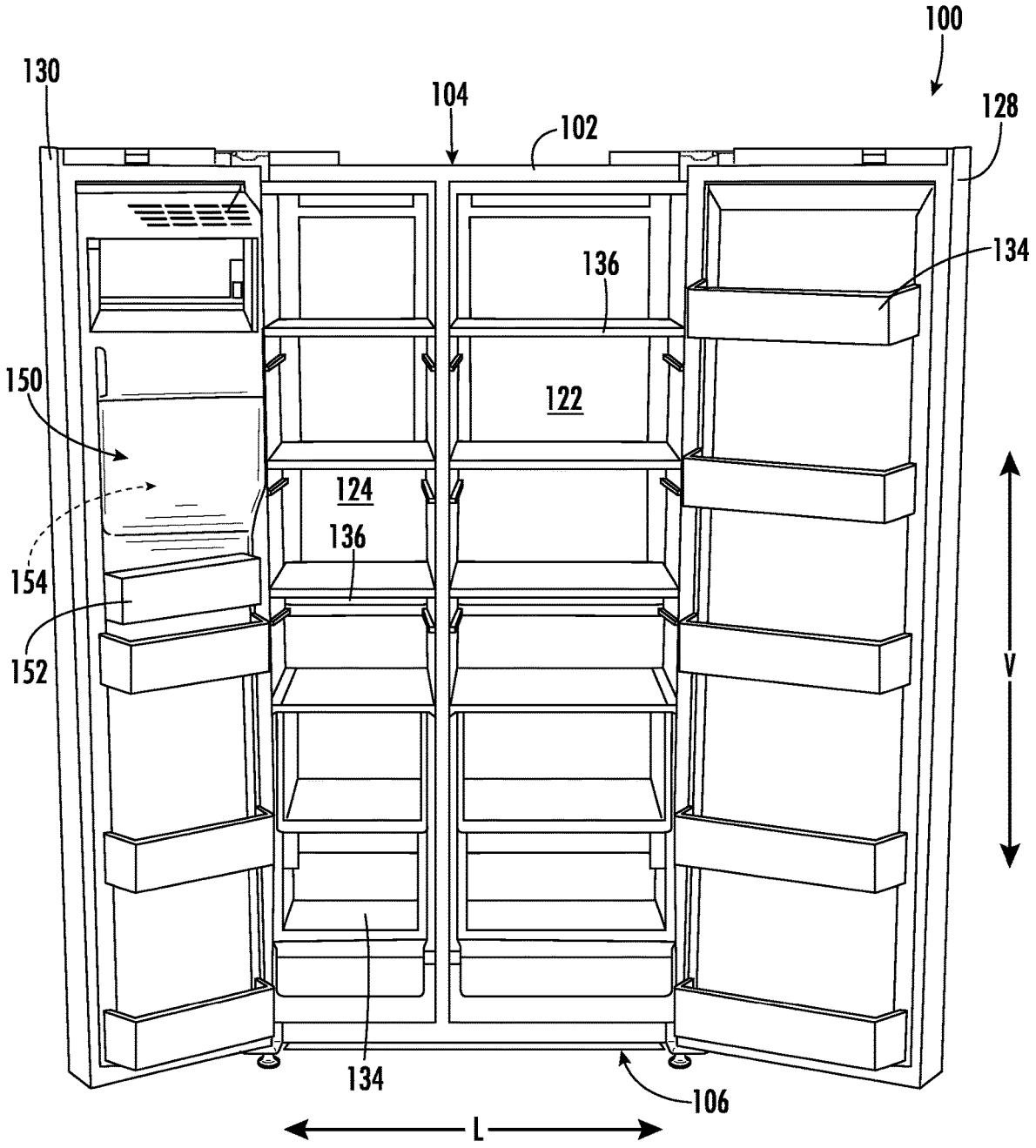
FIG. 2 provides a perspective view of the exemplary refrigerator appliance of FIG. 1, with the doors of the fresh food chamber and freezer chamber shown in an open position.

FIG. 2 provides a perspective view of refrigerator appliance 100 shown with refrigerator door 128 and freezer door 130 in the open position. As shown in FIG. 2, various storage components are mounted within fresh food chamber 122 to facilitate storage of food items therein as will be understood by those skilled in the art. In particular, the storage components may include bins 134 and shelves 136. Each of these storage components are configured for receipt of food items (e.g., beverages and/or solid food items) and may assist with organizing such food items. As illustrated, bins 134 may be mounted on refrigerator door 128 and freezer door 130 or may slide into a receiving space in fresh food chamber 122 or freezer chamber 124. It should be appreciated that the illustrated storage components are used only for the purpose of explanation and that other storage components may be used and may have different sizes, shapes, and configurations.

Referring now generally to FIG. 1, a dispensing assembly 140 will be described according to exemplary embodiments of the present subject matter. Dispensing assembly 140 is generally configured for dispensing liquid water and/or ice. Although an exemplary dispensing assembly 140 is illustrated and described herein, it should be appreciated that variations and modifications may be made to dispensing assembly 140 while remaining within the present subject matter.

Dispensing assembly 140 and its various components may be positioned at least in part within a dispenser recess 142 defined on freezer door 130. In this regard, dispenser recess 142 is defined on a front side 112 of refrigerator appliance 100 such that a user may operate dispensing assembly 140 without opening freezer door 130. In addition, dispenser recess 142 is positioned at a predetermined elevation convenient for a user to access ice and enabling the user to access ice without the need to bend-over. In the exemplary embodiment, dispenser recess 142 is positioned at a level that approximates the chest level of a user.

Dispensing assembly 140 includes an ice dispenser 144 including a discharging outlet 146 for discharging ice from dispensing assembly 140. An actuating mechanism 148, shown as a paddle, is mounted below discharging outlet 146 for operating ice or water dispenser 144. In alternative exemplary embodiments, any suitable actuating mechanism may be used to operate ice dispenser 144. For example, ice dispenser 144 can include a sensor (such as an ultrasonic sensor) or a button rather than the paddle. Discharging outlet 146 and actuating mechanism 148 are an external part of ice dispenser 144 and are mounted in dispenser recess 142.

As shown in FIGS. 2 through 7, inside refrigerator appliance 100, freezer door 130 may define an icebox 150 housing an icemaker and an ice storage bin 152 that are configured to form ice. In this regard, for example, icebox 150 may define an ice making chamber 154 for housing an ice making assembly, a storage mechanism, and a dispensing mechanism. According to the illustrated embodiment, icebox 150 is separate from dispensing assembly 140, e.g., for forming "craft ice" that is commonly large, clear cubes or spheres of ice for alcoholic or non-alcoholic drinks. For example, a user may access this craft ice by opening freezer door 130 and accessing storage bin 152 directly.

A control panel 160 is provided for controlling the mode of operation. For example, control panel 160 includes one or more selector inputs 162, such as knobs, buttons, touch-screen interfaces, etc., such as a water dispensing button and an ice-dispensing button, for selecting a desired mode of operation such as crushed or non-crushed ice. In addition, inputs 162 may be used to specify a fill volume or method of operating dispensing assembly 140. In this regard, inputs 162 may be in communication with a processing device or controller 164. Signals generated in controller 164 operate refrigerator appliance 100 and dispensing assembly 140 in response to selector inputs 162. Additionally, a display 166, such as an indicator light or a screen, may be provided on control panel 160. Display 166 may be in communication with controller 164, and may display information in response to signals from controller 164.

As used herein, "processing device" or "controller" may refer to one or more microprocessors or semiconductor devices and is not restricted necessarily to a single element. The processing device can be programmed to operate refrigerator appliance 100 and dispensing assembly 140. The processing device may include, or be associated with, one or more memory elements (e.g., non-transitory storage media). In some such embodiments, the memory elements include electrically erasable, programmable read only memory (EEPROM). Generally, the memory elements can store information accessible processing device, including instructions that can be executed by processing device. Optionally, the instructions can be software or any set of instructions and/or data that when executed by the processing device, cause the processing device to perform operations.

Referring now generally to FIGS. 3 through 7, an ice making assembly 200 that may be used with refrigerator appliance 100 will be described according to exemplary embodiments of the present subject matter. As illustrated, ice making assembly 200 is mounted in icebox 150 within ice making chamber 154 and is configured for receiving a flow of water from a water supply spout 202. More specifically, as described in more detail below, water supply spout 202 may discharge a flow of water into a resilient mold 204 where it may freeze and form ice cubes which may be stored in storage bin 152.

However, it should be appreciated that ice making assembly 200 is described herein only for the purpose of explaining aspects of the present subject matter. Variations and modifications may be made to ice making assembly 200 while remaining within the scope of the present subject matter. For example, ice making assembly 200 could instead be positioned within fresh food chamber 122 of refrigerator appliance 100 and may have any other suitable configuration.

In general, resilient mold 204 defines one or more chambers 206 for the making of an ice shape 208, e.g., such as a two ice pieces 208 of a predetermined shape. It should be appreciated that resilient mold 204 may have any suitable number, configuration, and geometry of chambers 206. For example, chambers 206 may be rectangular, spherical, etc. In addition, ice shape 208 has a diameter or largest dimension of 2 inches, 3 inches, or larger. Other sizes may also be created. In this exemplary embodiment, mold 204 is constructed from a flexible or resilient material. In one exemplary aspect, mold 204 is constructed from a silicone rubber.

According to the illustrated embodiment, ice making assembly 200 may further include a mold frame 210 for supporting resilient mold 204. According to example embodiments, ice making assembly 200 may further include a heat exchanger 212 in thermal communication with resilient mold 204 to facilitate freezing of the water supplied from water supply spout 202 to form one or more ice cubes 208. Specifically, according to the illustrated embodiment, heat exchanger 212 may be attached to mold frame 210 and may define one or more recessed cavities 214 within which resilient mold 204 may be seated. As heat exchanger 212 is cooled, ice 208 may be formed.

Figure 3:
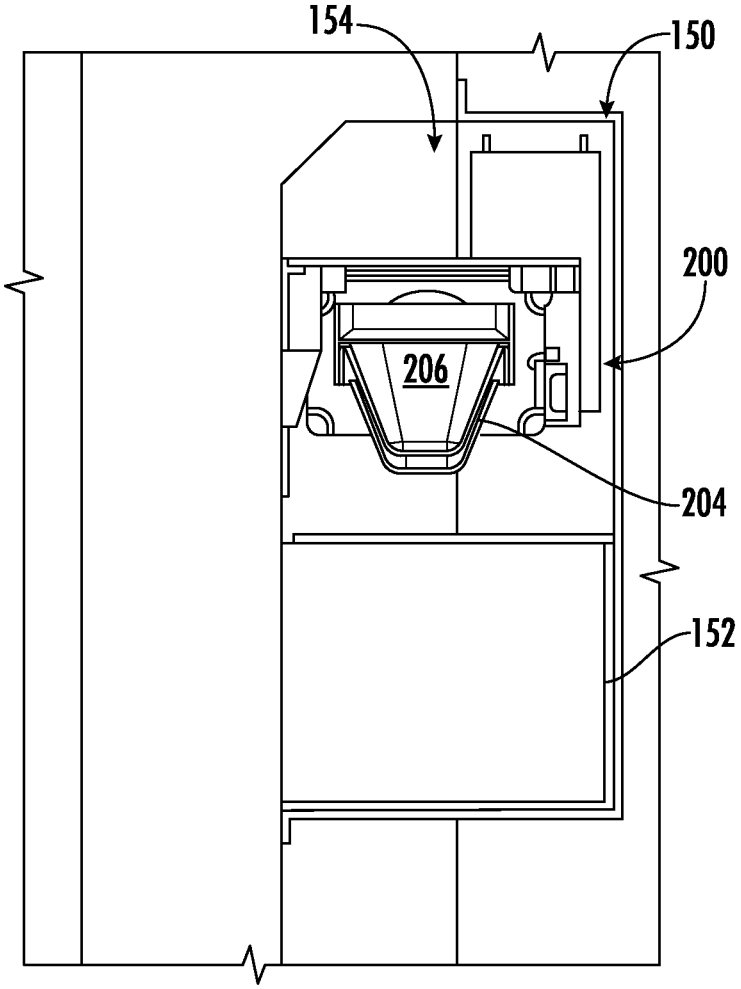
FIG. 3 provides a side cross-sectional view of an icebox and ice making assembly for use with the exemplary refrigerator appliance of FIG. 1 according to an exemplary embodiment of the present subject matter.
Figure 4:
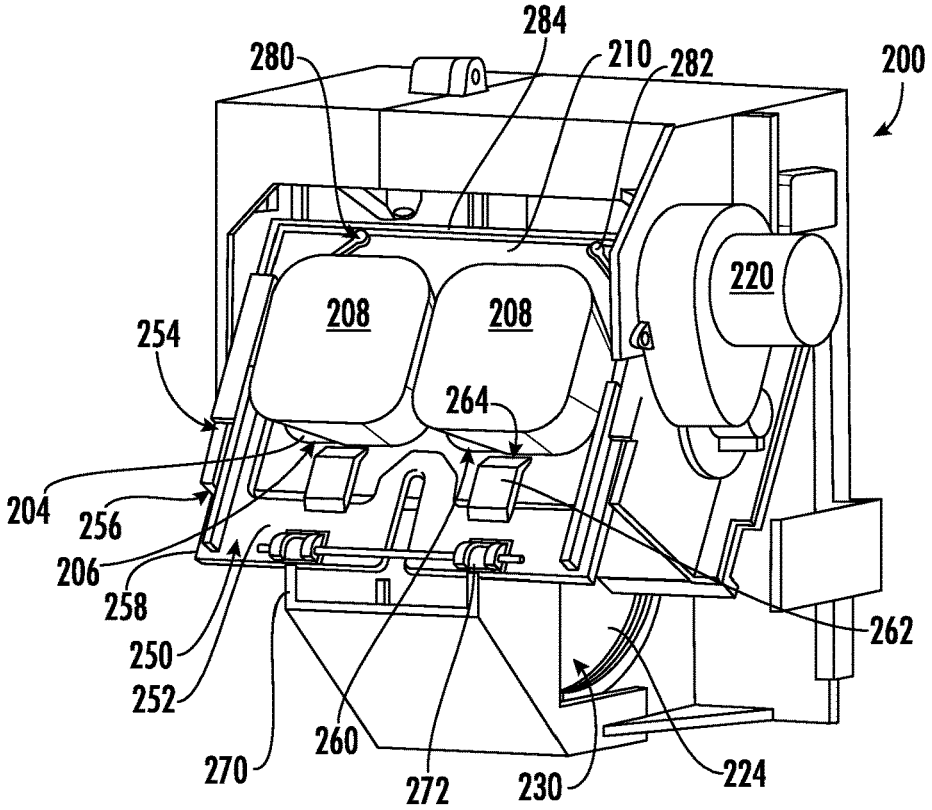
FIG. 4 provides a perspective view of the example ice making assembly of FIG. 3 according to an exemplary embodiment of the present subject matter.
Figure 5:
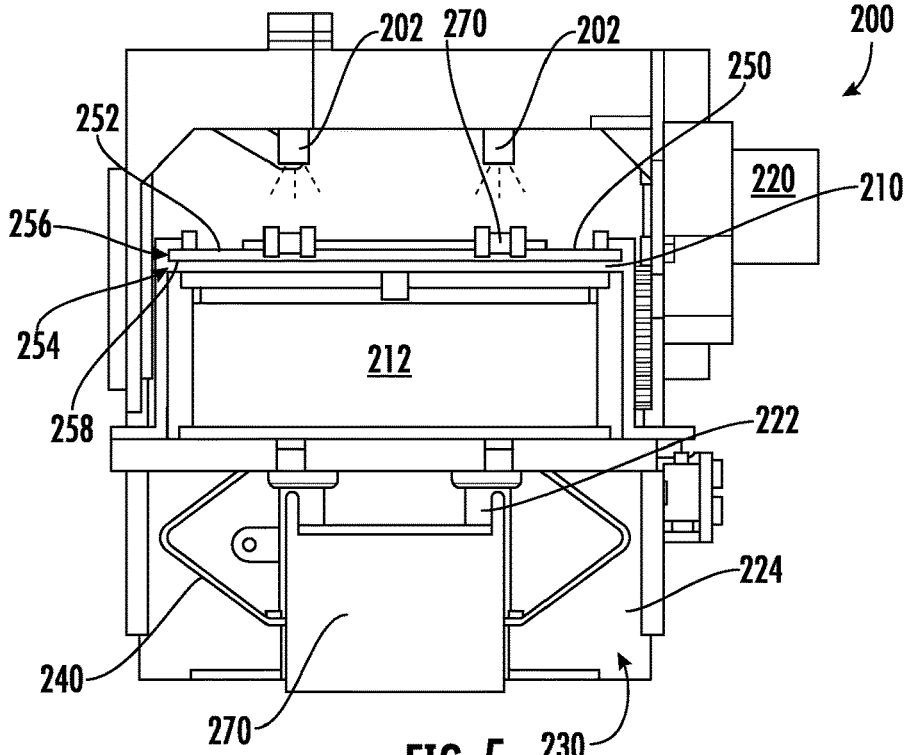
FIG. 5 provides a front view of the example ice making assembly of FIG. 3 during the ice freezing process according to an exemplary embodiment of the present subject matter.
Figure 6:
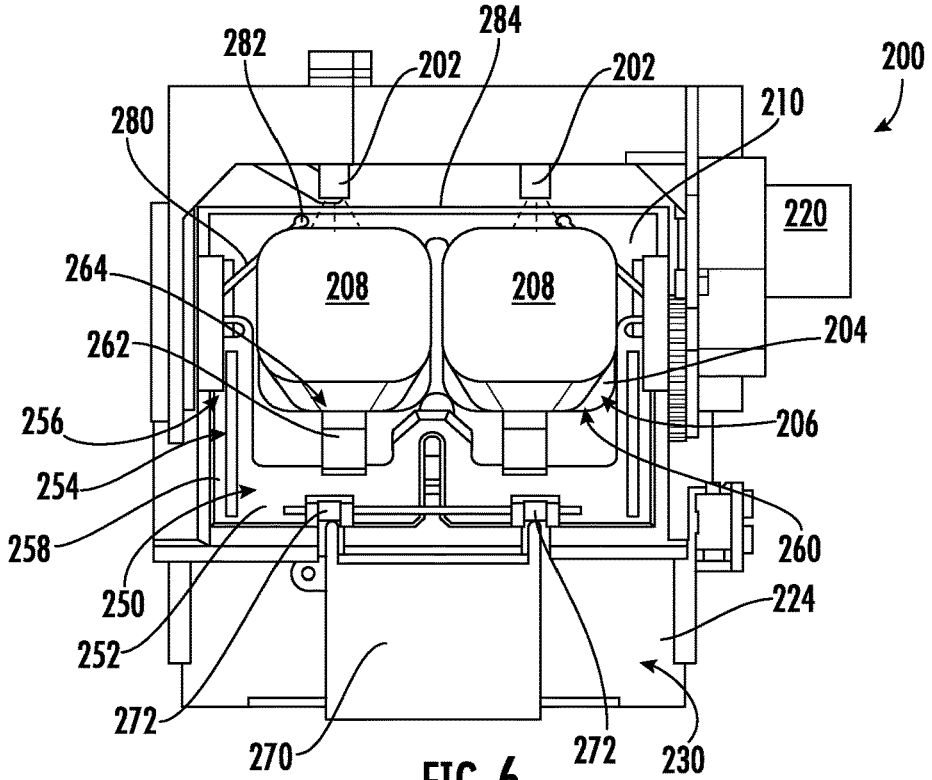
FIG. 6 provides a front view of the example ice making assembly of FIG. 3 during an ice discharge process according to an exemplary embodiment of the present subject matter.
Figure 7:
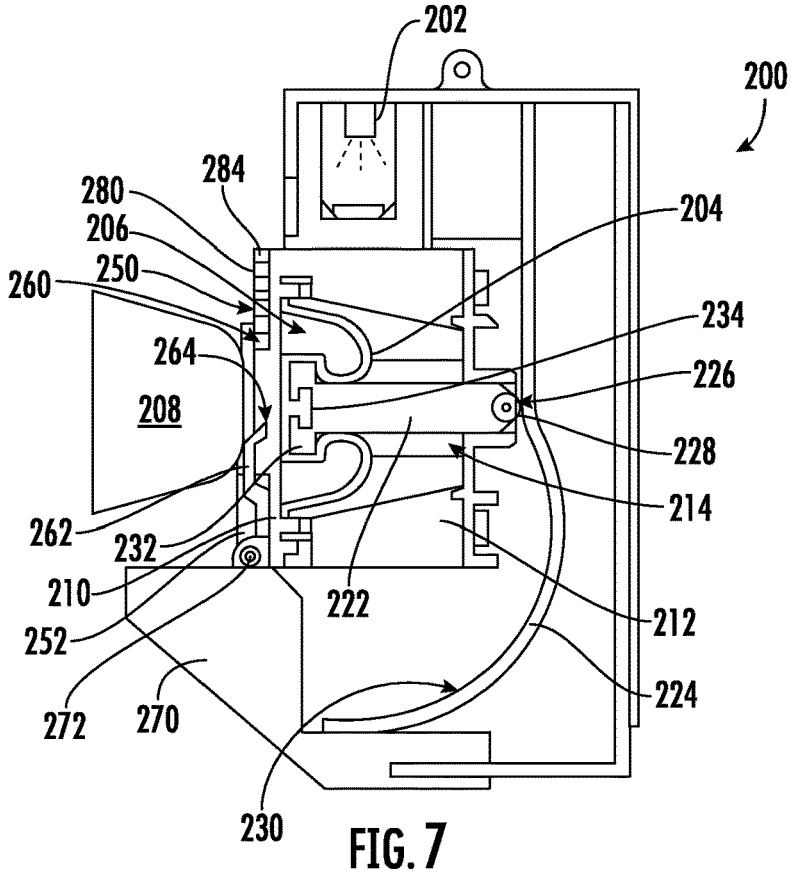
FIG. 7 provides a side view of the example ice making assembly of FIG. 3 during an ice discharge process according to an exemplary embodiment of the present subject matter.

According to an example embodiment, mold frame 210 is generally rotatable between a first position (e.g., as shown in FIGS. 3 and 5), through an intermediate position (e.g., as shown in FIGS. 4 and 6), to a second position (e.g., as shown in FIG. 7). In the first position, resilient mold 204 can be filled with water from a water supply spout 202. For example, a valve (not shown) can be activated by controller 164 as part of an ice making process to provide the appropriate amount of water to flow into resilient mold 204 when it is in the first position. According to example embodiments, ice making assembly 200 may further include one or more limit switches that are in operative communication with controller 164 to facilitate determination of the position of mold frame 210. As will be described in more detail below, as mold frame 210 rotates from the first position to the second position, formed ice 208 is slowly separated from resilient mold 204 and discharged from ice making assembly 200 (e.g., into storage bin 152).

A motor 220 may be operated by controller 164 and may be used to rotate mold frame 210 and resilient mold 204. In addition, a lifter mechanism 222 may be positioned adjacent to resilient mold 204 and may be mechanically coupled to mold frame 210 such that movement of mold frame 210 between the first and second position also moves lifter mechanism 222 between a first position (e.g., FIGS. 5 and 8) and a second position (e.g., an extended position as shown in FIG. 7). In this manner, lifter mechanism 222 facilitates the deformation of resilient mold 204, the separation of ice 208 from resilient mold 204, and the injection of ice 208 from ice making assembly 200.

For this exemplary embodiment, movement of lifter mechanism 222 is determined by a cam 224. More particularly, a terminal end 226 of lifter mechanism 222 includes a cam follower 228 or wheel that rides along an arcuate path 230 defined by cam 224. The arcuate path 230 determines the position of lifter mechanism 222 as mold 204 and lifter mechanism 222 rotate together from the first position to the second position.

An exemplary method of operating ice making assembly 200 will now be set forth using the described exemplary embodiment. One of skill in the art, using the teachings disclosed herein, will understand that other exemplary methods of operation may be use as well.

After chamber 206 has been filled with an appropriate amount of water as explained previously, the water is allowed to freeze. During the filling and freezing process, mold 204 is maintained in the first position during which lifter mechanism 222 also remains in the retracted position. In one exemplary aspect of the invention, the water may be filtered to remove particulates and may be cooled along a controlled temperature and time profile to provide clearer ice. Temperature (as measured by a temperature sensor, not shown) may be monitored so that e.g., controller 164 may determine when the water has been converted into ice shape 208.

After a determination has been made that the water has frozen to form ice shape 208, controller 164 can activate motor 220 to begin rotation of mold 204. As mold 204 rotates about an axis of rotation, a head 232 of lifter mechanism 222 is forced to press against a bottom surface 234 of resilient mold 204. As mold 204 rotates, lifter mechanism 222 moves along a direction perpendicular to the axis of rotation. Rotation forces lifter mechanism 222 to also move because cam follower 228 is riding on arcuate path 220. Referring to FIG. 7, a center of a radius defining arcuate path 230 is offset by a distance from the axis of rotation. As such, rotation shortens the distance between the bottom of resilient mold 204 and the arcuate path 230 of cam 224—forcing lifter mechanism 222 to slide toward and deform resilient mold 204. The ice 208 is also rotated but, more importantly, is forced to move in the same direction as lifter mechanism 222 by the pressing of head 232. This pressing forces ice shape 208 at least partially out of mold chamber 206.

For the exemplary embodiment described above, ice mold 204 and lifter mechanism 222 rotate 90 degrees between the first position and the second position. In other embodiments, a different degree of rotation may be used. Additionally, gravity and/or the resiliency of resilient mold may be used to return lifter mechanism 222 to the retracted position. A spring 240 (see FIG. 5) that is extended as lifter mechanism 222 is extended could also be used to urge lifter mechanism 222 back to its retracted position.

Referring now specifically to FIGS. 4 through 8, ice making assembly 200 may further include a sweep assembly 250 to facilitate extraction of ice 208 from resilient mold 204. In this regard, ice 208 may sometimes partially adhere to resilient mold 204 such that it is not fully released from resilient mold 204 when mold frame 210 reaches the second position. Accordingly, aspects of the present subject matter are directed to additional features of ice making assembly 200 that facilitate improved extraction of ice 208. Although a specific structure of sweep assembly 250 is described herein, it should be appreciated that variations and modifications to sweep assembly 250 may be made while remaining within the scope of the present subject matter.

As shown, sweep assembly 250 may generally include a sweep blade 252 that is slidably mounted to mold frame 210 over resilient mold 204. In this regard, as illustrated, sweep blade 252 may be slidably engaged with mold frame 210 using one or more linear slide bearings 254. More specifically, mold frame 210 may define a channel 256 and sweep blade 252 may define an edge 258 that is slidably received within channel 256. In this manner, movement of sweep blade 252 may be restricted to a direction perpendicular to the direction of motion of lifter mechanism 222.

Figure 8:
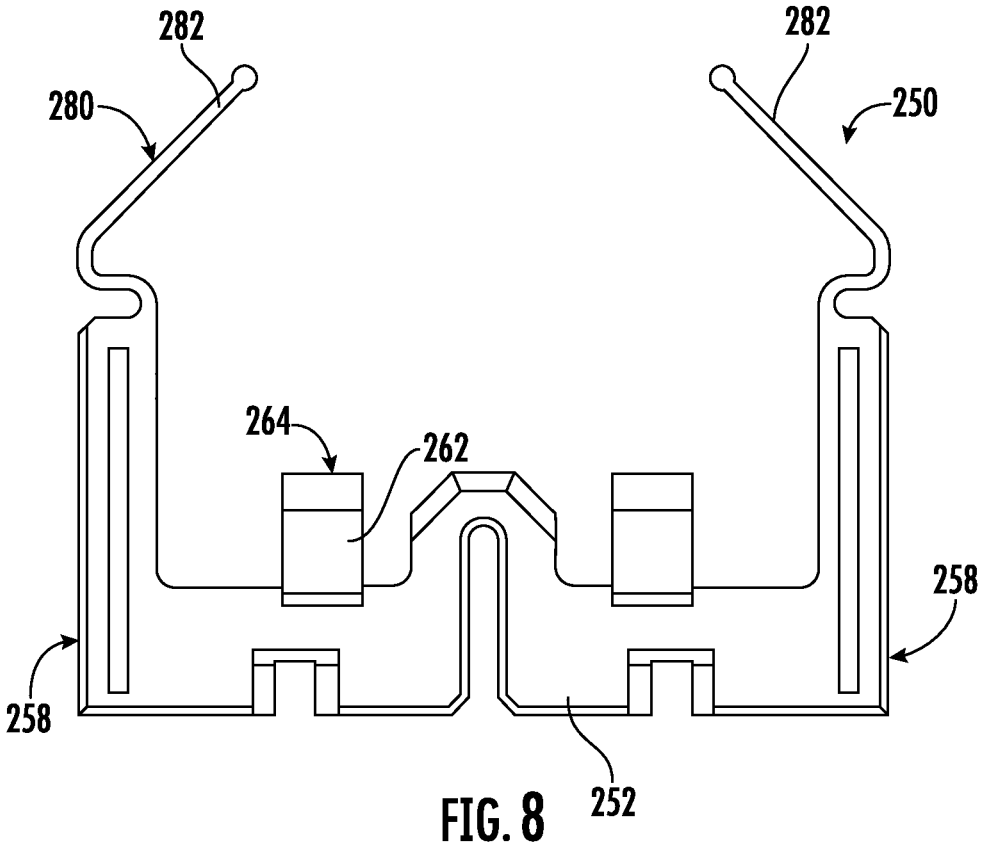
FIG. 8 provides a top view of a sweep assembly of the example ice making assembly of FIG. 3 according to an exemplary embodiment of the present subject matter.

Notably, according to example embodiments, sweep assembly 250 is mechanically coupled to mold frame 210 such that sweep blade 252 moves between a first position and a second position as mold frame 210 moves between the first position and the second position. More specifically, sweep blade 252 may not interfere with or be positioned over an opening 260 of mold chamber 206 when in the first position (e.g., the relaxed position as shown in FIGS. 5 and 8). By contrast, as sweep blade 252 moves to the second position (e.g., as shown in FIG. 7), sweep blade 252 may slide over opening 260 to engage ice and facilitate extraction from resilient mold 204.

More specifically, as illustrated in the figures, sweep assembly 250 may further include one or more tines 262 that extend from sweep blade 252 toward mold chamber 206. These tines 262 may be designed to facilitate separation between ice 208 and resilient mold 204 as sweep blade 252 is moved towards the second position. For example, tines 262 may have a distal end 264 that is angled toward a bottom of resilient mold 204 to facilitate extraction of ice 208 and to direct the ice away from resilient mold 204 and toward storage bin 152.

It should be appreciated that sweep assembly 250 may be mechanically coupled to mold frame 210 any suitable manner that facilitates movement between first position and second position. However, according to the illustrated embodiment, ice making assembly 200 includes a mechanical stop 270 or another suitable structure that moves sweep blade 252 toward the second position as mold frame 210 and lifter mechanism 222 move toward second position. In this regard, during water dispensing and ice formation, sweep blade 252 may be in the retracted position such that it is positioned away from mold chamber 206. As mold frame 210 is rotated during the ice ejection process, sweep blade 252 may contact mechanical stop 270 such that it is forced toward the second position under restraint of linear slide bearings 254. More specifically, according to the illustrated embodiment, sweep assembly 250 may include one or more rollers 272 that are mounted to sweep blade 252 for engaging mechanical stop 270 and causing sweep blade 252 to move toward the second position.

Notably, in order to avoid tines 262 from protruding over opening 260 of resilient mold 204 before ice 208 has been sufficiently lifted out of mold chamber 206, it may be desirable to prevent engagement between sweep blade 252 and mechanical stop 270 until mold frame 210 has been rotated through a target angle of rotation. For example, lifter mechanism 222 may define a stroke length measured between the first position in the second position. According to example embodiments, rollers 272 are designed not to contact mechanical stop 270 until after lifter mechanism 222 has moved through a certain percentage of the stroke length. For example, rollers 272 may engage mechanical stop 270 after lifter mechanism 222 has moved through 50%, 60%, 75%, 85%, or greater of the stroke length (which may correspond to a degree of rotation of mold frame 210).

Notably, it is also desirable to ensure that sweep blade 252 moves back to the first position after mold frame 210 is rotated back to the first position. In this manner, a subsequent water dispensing and ice forming operation may be performed. According to an example embodiment, sweep assembly 250 may include one or more resilient elements 280 that are configured for urging sweep blade 252 toward the first position. For example, according to the illustrated embodiment, resilient elements 280 include two resilient arms 282 that extend from sweep blade 252 around mold chambers 206 and that engage a back wall 284 of mold frame 210. As mold frame 210 is rotated toward the second position, resilient arms 282 are compressed and sweep blade 252 facilitates extraction of ice 208. By contrast, as mold frame 210 is rotated toward the first position, resilient arms 282 urge sweep blade 252 to the first position.

As explained herein, aspects of the present subject matter are generally directed to a sweep system in a refrigerator ice maker that ensures ice is released from a rubber mold. The sweep system may include a plastic blade attached to the top surface of a mold assembly frame. During harvest, the mold assembly may be rotated about 60 degrees from its horizontal home position; at this angle the cubes are partially ejected from the mold. As the rotation continues, rollers attached to the blade may interfere with a fixed stop to move the blade relative to the frame surface during which a linear slide bearings on the mold assembly frame keeps the blade aligned with the direction of travel. During this rotation, tines on the blade may engage or interfere with the ice cubes, effectively extracting and releasing the cubes from the rubber mold. Two plastic springs on the blade assembly that may be deformed by the sliding motion of the blade during harvesting and push the blade back to the nominal position as the mold assembly rotates back to the home position.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice making assembly for a refrigerator appliance, the ice making assembly comprising:

a resilient mold defining a mold cavity for receiving water;

a mold frame for supporting the resilient mold, the mold frame being rotatable between a first position and a second position;

a heat exchanger in thermal communication with the resilient mold to freeze the water and form one or more ice cubes;

a lifter mechanism positioned adjacent to the resilient mold and rotatable with the mold frame between the first position and the second position, the lifter mechanism configured to deform the resilient mold as the mold frame rotates between the first position and the second position; and a sweep assembly to facilitate extraction of the one or more ice cubes from the resilient mold, the sweep assembly comprising:

a sweep blade slidably mounted to the mold frame over the resilient mold and being movable between a first position and a second position;

a mechanical stop that moves the sweep blade toward the second position as the lifter mechanism moves toward the second position; and one or more resilient elements for urging the sweep blade toward the first position.

2. The ice making assembly of claim 1, wherein the one or more resilient elements are resilient arms that extend from the sweep blade and that are deflected when the sweep blade is in the second position.

3. The ice making assembly of claim 2, wherein the resilient arms engage a back wall of the mold frame when the sweep blade is in the second position.

4. The ice making assembly of claim 1, wherein the sweep assembly further comprises:

one or more rollers rotatably mounted to the sweep blade for engaging the mechanical stop as the lifter mechanism moves toward the second position.

5. The ice making assembly of claim 4, wherein the lifter mechanism defines a stroke length measured between the first position and the second position, and wherein the one or more rollers do not contact the mechanical stop until after the lifter mechanism has moved through 75% of the stroke length.

6. The ice making assembly of claim 1, wherein the mold frame and the sweep blade are engaged through linear slide bearings.

7. The ice making assembly of claim 1, wherein the mold frame defines a channel and the sweep blade defines an edge that slides within the channel as the sweep blade moves between the first position and the second position.

8. The ice making assembly of claim 1, wherein the sweep assembly further comprises:

one or more tines that extend from the sweep blade and over the resilient mold to engage the one or more ice cubes.

9. The ice making assembly of claim 8, wherein the one or more tines have a distal end that is angled toward the resilient mold.

10. The ice making assembly of claim 1, further comprising:

a cam in mechanical communication with the lifter mechanism, the cam defining an arcuate path that is followed by one end of the lifter mechanism as it rotates between the first position and the second position.

11. The ice making assembly of claim 1, further comprising:

a motor for rotating the mold frame and the lifter mechanism from the first position to the second position.

12. A refrigerator appliance defining a vertical direction, a lateral direction, and a transverse direction, comprising:

a cabinet defining a chilled chamber;

a door being rotatably mounted to the cabinet to provide selective access to the chilled chamber;

an icebox mounted to the door and defining an ice making chamber; and an ice making assembly positioned within the ice making chamber, the ice making assembly comprising:

a resilient mold defining a mold cavity for receiving water;

a mold frame for supporting the resilient mold, the mold frame being rotatable between a first position and a second position;

a heat exchanger in thermal communication with the resilient mold to freeze the water and form one or more ice cubes;

a lifter mechanism positioned adjacent to the resilient mold and rotatable with the mold frame between the first position and the second position, the lifter mechanism configured to deform the resilient mold as the mold frame rotates between the first position and the second position; and a sweep assembly to facilitate extraction of the one or more ice cubes from the resilient mold, the sweep assembly comprising:

a sweep blade slidably mounted to the mold frame over the resilient mold and being movable between a first position and a second position;

a mechanical stop that moves the sweep blade toward the second position as the lifter mechanism moves toward the second position; and one or more rollers rotatably mounted to the sweep blade for engaging the mechanical stop as the lifter mechanism moves toward the second position.

13. The refrigerator appliance of claim 12, wherein the sweep assembly further comprises:

one or more resilient elements for urging the sweep blade toward the first position.

14. The refrigerator appliance of claim 13, wherein the one or more resilient elements are resilient arms that extend from the sweep blade and that are deflected when the sweep blade is in the second position.

15. The refrigerator appliance of claim 12, wherein the lifter mechanism defines a stroke length measured between the first position and the second position, and wherein the one or more rollers do not contact the mechanical stop until after the lifter mechanism has moved through 75% of the stroke length.

16. The refrigerator appliance of claim 12, wherein the mold frame and the sweep blade are engaged through linear slide bearings.

17. The refrigerator appliance of claim 12, wherein the sweep assembly further comprises:

one or more tines that extend from the sweep blade and over the resilient mold to engage the one or more ice cubes.

18. The refrigerator appliance of claim 12, further comprising:

a cam in mechanical communication with the lifter mechanism, the cam defining an arcuate path that is followed by one end of the lifter mechanism as it rotates between the first position and the second position; and a motor for rotating the mold frame and the lifter mechanism from the first position to the second position.

19. An ice making assembly for a refrigerator appliance, the ice making assembly comprising:

a resilient mold defining a mold cavity for receiving water;

a mold frame for supporting the resilient mold, the mold frame being rotatable between a first position and a second position;

a heat exchanger in thermal communication with the resilient mold to freeze the water and form one or more ice cubes;

a lifter mechanism positioned adjacent to the resilient mold and rotatable with the mold frame between the first position and the second position, the lifter mechanism configured to deform the resilient mold as the mold frame rotates between the first position and the second position; and a sweep assembly to facilitate extraction of the one or more ice cubes from the resilient mold, the sweep assembly comprising:

a sweep blade slidably mounted to the mold frame over the resilient mold and being movable between a first position and a second position;

a mechanical stop that moves the sweep blade toward the second position as the lifter mechanism moves toward the second position; and one or more tines that extend from the sweep blade and over the resilient mold to engage the one or more ice cubes.

20. The ice making assembly of claim 19, wherein the one or more tines have a distal end that is angled toward the resilient mold.

* * * * *